United States Patent [19]

Gorring et al.

[11] 3,972,853

[45] Aug. 3, 1976

[54] PROCESS FOR STABILIZING LUBRICATING OIL WITH ELEMENTAL SULFUR

[75] Inventors: Robert L. Gorring, Washington Crossing, Pa.; Eric J. Y. Scott, Princeton; Robert L. Smith, Hopewell, both of N.J.

[73] Assignee: Mobil Oil Corporation, New York, N.Y.

[22] Filed: Aug. 8, 1974

[21] Appl. No.: 495,591

[52] U.S. Cl. ..... 252/45; 208/293

[51] Int. Cl.[2] ..... C10M 1/12

[58] Field of Search ..... 208/293, 251, 88; 204/158 S; 252/45; 260/139

[56] References Cited

UNITED STATES PATENTS

| | | | |
|---|---|---|---|
| 2,222,431 | 11/1940 | Colin | 252/45 |
| 2,356,843 | 8/1944 | Henry | 252/45 |
| 2,378,803 | 6/1945 | Smith | 252/45 |
| 2,683,683 | 7/1954 | Mills | 208/251 |
| 2,790,751 | 4/1957 | Gerald | 208/253 |
| 2,854,399 | 9/1958 | Weller | 208/293 |
| 3,245,892 | 4/1966 | Jones | 204/158 S |

FOREIGN PATENTS OR APPLICATIONS

| | | | |
|---|---|---|---|
| 699,206 | 10/1940 | Germany | 208/293 |

*Primary Examiner*—G. J. Crasanakis
*Attorney, Agent, or Firm*—Charles A. Huggett; Raymond W. Barclay; Dennis P. Santini

[57] ABSTRACT

A stabilized lubricating oil resistant to oxidation and sludge formation upon exposure to an oxidative environment is prepared without forming undesirable color bodies therein by contacting the lubricating oil stock with a small amount of elemental sulfur of from about 0.1 to about 0.5 percent by weight at a contact temperature of from about 25°C to about 70°C and, thereafter, removing any unreacted sulfur therefrom.

5 Claims, No Drawings

PROCESS FOR STABILIZING LUBRICATING OIL WITH ELEMENTAL SULFUR

CROSS-REFERENCE TO RELATED APPLICATION

Application Ser. No. 495,593, filed on the same date herewith, is directed to treatment of lubricating oil stock with elemental sulfur followed by contact with a sulfide-forming metal and separation of oil product from metal sulfide-containing residue therein formed.

BACKGROUND OF THE INVENTION

1. Field of the Invention

This invention relates to the production of improved lubricating oils. In particular, it relates to the preparation of stable lubricating oils without sacrifice in color which are highly resistant to oxidation and sludge formation when exposed to a highly oxidative environment.

2. Description of Prior Art

Hydrocarbon lubricating oils have been obtained by a variety of processes in which high boiling fractions are contacted with hydrogen in the presence of hydrogenation-dehydrogenation catalysts at elevated temperatures and pressures. In such processes, there is a consumption of hydrogen. Lubricating oil fractions are separated from the resulting products. Such lubricating oil fractions differ from those obtained by fractional distillation of crude oils and the like, since they have such relatively high viscosity index values that solvent extraction treatments are generally not required to enhance their viscosity index values. Such lubricating oil fractions suffer from the shortcoming that they are unstable when exposed to highly oxidative environments. When so exposed, sediment and lacquer formation occurs, thus lessening the commercial value of such lubricants.

Methods in the art directed to lessening such a shortcoming are exemplified by U.S. Pat. Nos. 3,436,334 and 3,530,061. They teach making a lubricating oil product fraction of hydrocracking resistant to deterioration upon exposure to light and air by contacting the lubricating oil fraction with a solid contacting agent having hydrogenation-dehydrogenation properties under hydrogen pressure (3,530,061); and making hydrocarbon lubricating oil resistant to such deterioration by contacting high boiling hydrocarbons with a hydrogenation-dehydrogenation catalyst and hydrogen (with hydrogen consumption), and thereafter dehydrogenating the resultant product on contact with a metal oxide or with metal and oxygen (3,436,334). Both methods employ hydrogen atmosphere, high pressure and high temperature, i.e. 500°F to 1000°F. No sulfur is employed in either patent method.

U.S. Pat. Nos. 2,914,470 is directed to hydrorefining a petroleum oil fraction by contacting it with a catalyst in the presence of hydrogen sulfide. Temperatures and pressures taught for the process of this patent are 600° to 825°F and 150 psig to 3000 psig, respectively.

U.S. Pat. No. 2,432,440 is directed to a high temperature, high sulfur treatment of lubricating oil stocks to improve oxidative stability.

The present invention is directed to a process and means for effecting substantial improvement in oxidative properties of lubricating oil by a low pressure, low temperature contacting with a small amount of elemental sulfur in the absence of a catalyst.

U.S. Pat. No. 2,604,438 teaches a "hydroforming" process for catalytic dehydrogenation of light (i.e. boiling at less than 600°F) hydrocarbon oils, presumably to increase aromatic content. The patent discloses the known fact that in processes of that nature, the presence of a small amount of sulfur in the feed has a beneficial effect. It further states that when the oil to be "hydroformed" has no sulfur, i.e. no sulfur in the light hydrocarbon feed, then a small amount of sulfur, e.g., a reducible sulfur compound, is added to the feed. The patent emphasizes that the invention disclosed therein is only advantageous when the process is carried out at a temperature of at least 825°F.

The prior art practices of hydrofinishing and hydrotreating as a means of treatment of lubricating oil stocks (i.e. stocks boiling at temperatures over 600°F) leave behind the unstable oil fractions, i.e., hydroaromatic compounds, with labile hydrogen atoms such as, for example, fluorenes, benzofluorenes, acenaphthenes, tetralin, fused cycloalkylaromatics and naphthenes, which are quite unstable toward oxygen, particularly in the presence of metals in lubricating oil formulations containing overbased additives. These hydroaromatic compounds with labile hydrogen atoms are known to be present in small quantities in conventionally furfural refined stocks and can lead to oxidative instability of any lubricant containing them. Further, it is well known that the sensitivity of certain lubricating oils toward alkaline additives can cause oxidative degradation in applications where overbased additives are used, such as automotive and diesel lubricants. Also, metal sensitivity can be quite detrimental to the oxidative stability of lubricants or functional fluids in applications such as turbine circulating oils, steam turbine oils and hydraulic fluids. No method is known at present which so effectively and easily alleviates the above problems as the present invention.

SUMMARY OF THE INVENTION

In accordance with the present invention there is provided a process and means for forming lubricating oils which are highly resistant to deterioration, e.g. oxidation and sludge formation, upon exposure to a highly oxidative environment.

The process of the present invention comprises contacting a lubricating oil stock, such as, for example, from a Midcontinental U.S.A. crude or an Arabian Light crude, with elemental sulfur in amount of from about 0.05 to about 1.0 percent by weight of the oil stock at a mild temperature of from about 25°C. to about 130°C., and, thereafter, removing unreacted sulfur therefrom.

The elemental sulfur for use herein may be added as such or may be generated in situ, and therefore, may be provided for the process, if desired, by a sulfur precursor, such as, for example, $H_2S$, or an added organosulfur compound.

Non-limiting examples of sulfur precursors which may be utilized in the present process include $H_2S$, RSH, $RS_xH$, $HS_xH$ and $RS_xR$, wherein R is a hydrocarbyl group and x is an integer of from 1 to 4 or more.

The preferred form of sulfur for use herein is crystalline, such as that produced by recrystallization of sublimed sulfur from toluene.

To remove the unreacted sulfur from the lubricating oil stock contacted with the elemental sulfur, any one of a number of prior art methods may be used. As an embodiment of such methods, the oil stock so contacted may be treated with an alkaline solution of sodium sulfide to effect removal of unreacted sulfur without impairing the oxidative stability of the lubricating oil stock product. This method is demonstrated in U.S. Pat. No. 2,432,440.

DESCRIPTION OF SPECIFIC EMBODIMENTS

The lubricating oil stock which may be treated in accordance with the present invention may generally be any high boiling range material boiling above about 600°F. Such lubricating oil stock materials include those obtained by fractionation, as by, for example, vacuum distillation, of crude oils identified by their source, i.e. Pennsylvania, Midcontinent, Gulf Coast, West Texas, Amal, Kuwait, Barco and Arabian. Said oil stock material may be one having a substantial part thereof of the fractionation product of the above crude oils mixed with other oil stocks.

The elemental sulfur employed in the present process may be crystalline, amorphous or colloidal and may be any of several allotropic forms such as $S_6$, $S_8$ or polymeric sulfur, and may be used in small amounts of from about 0.5 to about 1.0 percent by weight of oil stock, with a preferable range of from about 0.1 to about 0.5 percent by weight. It is readily observable that this invention differs from the well-known method of making sulfurized oil-extreme pressure agents in conditions of processing, the concept of improvement, the amount and type of sulfur incorporated and the chemical modification of the oil stock itself. In the present invention, small amounts of stable sulfur may possibly be chemically incorporated into the oil molecules as labile hydrogen atoms are reoved. On the other hand, in sulfurized oils used as extreme pressure agents, large quantities of sulfur, such as, for example, 10 to 15 percent by weight, are incorporated, including a substantial quantity of elemental sulfur as such.

The operating parameters in the present process are generally such as to achieve the desired result of degree of improvement or upgrading product quality of the lubricating oil stock treated without loss in yield and without forming undesirable color bodies therein. Aside from specific small amounts of sulfur, the temperature of the process must be within the range of from about 25° to about 130°C., with a preferred range of from about 25° to 70°C. Also, the pressure of the process must be within the range of from about 0 psig. to about 100 psig., with a preferred range of from about 0 psig. to about 5 psig.

In order to more fully illustrate the process of the present invention, the following specific examples, which in no sense limit the invention, are presented. The test procedures used in evaluation of the product yield from the present process are standard tests designated ASTM: D2272-67 ("RBOT" oxidation stability test) and ASTM: D156-64 (color test).

EXAMPLES 1–6

The lubricating oil stock used in these examples was conventionally refined by furfural extraction and methyl ethyl ketone dewaxing. It is referred to as Arab Light stock and has the following significant properties:

TABLE 1

| | | |
|---|---|---|
| Viscosity: | KV at 100°F, cs | 31.41 |
| | KV at 210°F, cs | 5.21 |
| | SUS at 100°F | 147.8 |
| | SUS at 210°F | 43.3 |
| Viscosity Index | | 106 |
| VI Adjusted to 20 Pour | | 110 |
| Pour Point, °F | | 0 |
| Flash Point, °F | | 420 |
| Color, ASTM | | L 1.5 |
| TAN | | 0.0 |
| CCR, Wt. % | | <0.01 |
| API Gravity | | 30.5 |
| Sulfur, Wt. % | | 0.82 |
| Furfural Treatment | | to 67% yield |
| Furfural Content, ppm | | <1 |

A series of 6 tests were conducted using the above oil stock. All of the oils tested were blended with an additive package constituting less than one weight percent of the oil.

The so blended oil stock, without further treatment, was then subjected to the aforementioned RBOT and color tests as Example 1.

As Example 2, a quantity of the test oil containing the additive package was washed twice with 10 percent aqueous NaCl until the aqueous layer had a pH of 7 and then with distilled water until the aqueous layer was free of chloride ions (as determined by an $AgNO_3$ test). The temperature during the entire wash procedure never exceeded 70°C. Again, the aforementioned RBOT and color tests were used in evaluation of the second product.

As Example 3, a quantity of said oil stock was charged into an ultrasonic bath container and contacted with 0.01 weight percent elemental sulfur (recrystallized) during ultrasonic agitation at 65° to 70°C for 2 hours. The oil stock was then blended with the same additive package as in Example 1. The final product oil stock was then subjected to the aforementioned RBOT and color tests.

As Example 4, a quantity of said oil stock was charged into said ultrasonic bath container and contacted with 0.1 weight percent elemental sulfur (recrystallized) during ultrasonic agitation at 65° to 70°C. for 2 hours. The oil stock was then blended with the same additive package as in Example 1 and subjected to the RBOT and color tests.

As Example 5, another quantity of said oil stock was charged into said ultrasonic bath container and contacted with 0.5 weight percent elemental sulfur (recrystallized) during ultrasonic agitation at 65° to 70°C for 2 hours. The oil stock was then washed as above with NaCl solution and distilled water and blended with the same additive package as in Example 1. The final product was then subjected to the RBOT and color tests.

As Example 6, a further quantity of said oil stock was charged into a container fitted with a stirrer and contacted with 0.5 weight percent sulfur (recrystallized) during stirring at 65° to 70°C for 2 hours. The oil stock was then washed as above and blended with the same additive package as in Example 1. The final product was then evaluated in the RBOT and color tests.

The results of Examples 1 – 6 appear in Table 2 below:

TABLE 2

Results From Examples 1 - 6

| Example | Elemental Sulfur Added, % | Method of Sulfur Addition | Wash[1] | RBOT, Minutes | Color |
|---|---|---|---|---|---|
| 1 | 0 | — | None | 300 | 1½ |
| 2 | 0 | — | Yes | 315 | 1⅜ |
| 3 | .01 | Ultrasonic bath, 65-70°C | None | 330 | 1½ |
| 4 | .1 | Ultrasonic bath, 65-70°C | None | 420 | 1½ |
| 5 | .5 | Ultrasonic bath, 65-70°C | Yes | 430 | 1½ |
| 6 | .5 | Stirring, 65-70°C | Yes | 465 | 1⅛ |

[1]Washing to remove unreacted sulfur when the oil stock was contacted with elemental sulfur.

It is observed from the results of the foregoing examples, i.e., Examples 1, 5 and 6, that the process of the present invention substantially improves oxidative stability, measured in RBOT minutes, by 43 to 55 percent. Examples 1 and 2 show that a caustic washing procedure alone does not significantly improve oxidative stability. Also, since it can be shown that for the oil stock used in Examples 1-6, the upper limit of residual sulfur after caustic washing is 0.01 weight percent and since Example 3 shows clearly that 0.01 weight percent sulfur is not effective, the enhancement in oxidative stability here demonstrated is not due to residual sulfur.

Also, the results indicate that the color number of the oil, indicative of color bodies contained therein, does not increase by the method of the present invention.

EXAMPLES 7-16

To demonstrate that the process of the present invention provides a substantial benefit in that it stabilizes a lubricating oil stock without increasing color whereas a high temperature thermal process degrades the color properties of the same oil, Examples 7-16 were conducted.

The elemental sulfur provided for use in these examples was a commercial "Sublimed Sulfur" which was soxhlet-extracted with toluene. On cooling the hot sulfur solution, crystals of sulfur separated therefrom and were collected. They were filtered, washed with hexane and air dried. About 400 ml. of the same oil stock as used in Examples 1-6 was weighed into a 500 ml. Erlenmayer flask. Nitrogen was passed through the oil stock for about 10 minutes and the elemental sulfur was added to provide 0.5 weight percent of sulfur. Nitrogen was again passed through the oil stock and the flask was stoppered and immersed in an 80 Kc ultrasonic bath at 65°C until the sulfur was completely dissolved (about 2 hours). This oil stock was blended with the same additive package as in Examples 1 - 6. The color of the resultant solution was approximately the same as that of the original oil stock.

Portions of the above solution were separated to make up quantities for each of Examples 7 - 16. These quantities were run in an apparatus (conventional micro-unit) consisting of a vertical, downflow, annular, stainless steel reactor packed with 25 ml. 10/20 mesh vycor chips. Temperature and liquid hourly space velocity were varied for each example. The liquid effluent was collected in a spherical receiver heated at about 40°C and was purged continuously with argon (200 ml./minute). Essentially 100% of the feed was recovered as liquid product. The argon and product $H_2S$ passed through three traps, each containing 25 ml. of 1.7 M $CdSO_4$ in aqueous solution, magnetically stirred. Usually more than 90% of the total $H_2S$ was absorbed in the first trap. Periodically the traps were replaced, the cadmium sulfide was filtered and washed, and the free acid in the combined aqueous washings was titrated with 0.1 N NaOH solution. The recovered oil never contained more than a few percent of the total $H_2S$.

The resultant products of each example were subjected to the aforementioned color test. The results appear in Table 3 below:

TABLE 3

| Example | Temperature (°C) | LHSV ($Hr^{-1}$) | Conversion %S | Color |
|---|---|---|---|---|
| 7 | 175 | 0.86 | 0.7 | 2 |
| 8 | 250 | 0.84 | 57.1 | ≥8 |
| 9 | 250 | 7.70 | 15.3 | ≥8 |
| 10 | 220 | 3.34 | — | 5¾ |
| 11 | 210 | 0.84 | 11.6 | 7½ |
| 12 | 210 | 3.37 | 3.1 | 3¾ |
| 13 | 230 | 3.37 | 19.4 | 7¾ |
| 14 | 230 | 6.67 | 7.0 | 5½ |
| 15 | 230 | 0.87 | 25.5 | >8 |
| 16 | 230 | 0.84 | 44.3 | >8 |

[1]Flow in Example 16 was reversed to upflow

EXAMPLES 17 and 18

Two examples were conducted for the purpose of establishing minimum elemental sulfur concentration and minimum treating temperature. First, as Example 17, a quantity of the oil stock used in Examples 1-6 was charged into an ultrasonic bath container and contacted with 0.05 weight percent elemental sulfur (recrystallized) during ultrasonic agitation at 25°C. for 2 hours. The oil stock was then washed as in Example 6 and blended with the same additive package as in Example 6. The resultant oil product was evaluated in the RBOT and color tests.

Second, as Example 18, another quantity of the oil stock used in Examples 1-6 was processed as in Example 17, except that 0.5 weight percent elemental sulfur was used. This oil stock product also containing the same additive package as in Example 17 was tested in the RBOT and color tests. The results of Examples 17 and 18 appear in Table 4 below:

TABLE 4

| Example | Elemental Sulfur Added, % | Method of Sulfur Addition | Wash[1] | RBOT Minutes | Color |
|---|---|---|---|---|---|
| 17 | 0.05 | Ultrasonic Bath | Yes | 375 | 1½ |
| 18 | 0.5 | Ultrasonic Bath | Yes | 402 | 1½ |

TABLE 4-continued

| Example | Elemental Sulfur Added, % | Method of Sulfur Addition | Wash[1] | RBOT Minutes | Color |
|---|---|---|---|---|---|
| | | at 25°C | | | |

[1]Washing to remove unreacted sulfur.

Having thus given a general description of the process and means of this invention and provided by way of examples specific embodiments thereof, it is to be understood that no undue restrictions are to be imposed by reason thereof, and minor modifications may be made thereto without departing from the scope thereof.

What is claimed is:

1. A process for forming a stablized lubricating oil resistant to oxidation and sludge formation upon exposure to an oxidative environment which comprises contacting a hydrocarbon lubricating oil stock having a boiling range above about 600°F with elemental sulfur in amount of from about 0.1 to about 0.5 percent by weight of said oil stock at a reaction temperature of between about 25°C and about 70°C and reaction pressure of from about 0 psig to about 100 psig for a reaction period of at least 2 hours and, washing the oil from said contacting step to remove any unreacted sulfur therefrom.

2. The process of claim 1 wherein said oil stock comprises a lubricating oil fraction obtained by fractionation of a crude oil identified as Pennsylvania, Midcontinent, Gulf Coast, West Texas, Amal, Kuwait, Barco or Arabian.

3. The process of claim 1 wherein said oil stock is a lubricating oil fraction obtained by fractionation of crude oil identified as Arabian.

4. The process of claim 1 wherein said elemental sulfur is crystalline.

5. The process of claim 4 wherein said crystalline sulfur is obtained by recrystallization of sublimed sulfur from toluene.

* * * * *